US006111347A

United States Patent [19]

Kwak

[11] Patent Number: 6,111,347

[45] Date of Patent: Aug. 29, 2000

[54] APERTURE GRILL FOR A COLOR CATHODE RAY TUBE

[75] Inventor: Jong-seop Kwak, Pusan-si, Rep. of Korea

[73] Assignee: Samsung Display Devices Co., Ltd., Kyungki-Do, Rep. of Korea

[21] Appl. No.: 09/123,586

[22] Filed: Jul. 28, 1998

[30] Foreign Application Priority Data

Aug. 29, 1997 [KR] Rep. of Korea ..... 97-42960

[51] Int. Cl.[7] ..... H01J 29/80

[52] U.S. Cl. ..... 313/402; 313/403; 313/407

[58] Field of Search ..... 313/402, 403, 313/404, 407, 269

[56] References Cited

U.S. PATENT DOCUMENTS 4,504,764 3/1985 Sakamoto et al. ..... 313/407
4,827,179 5/1989 Adler et al. ..... 313/407
5,647,653 7/1997 Cherukuri ..... 313/402
5,672,935 9/1997 Ito et al. ..... 313/407

*Primary Examiner*—Nimeshkumar D. Patel
*Assistant Examiner*—Todd Reed Hopper
*Attorney, Agent, or Firm*—Christie, Parker & Hale, LLP

[57] ABSTRACT

An aperture grill for a color cathode ray tube includes a mask having a plurality of slits, a frame for securing the mask in a taut state, and a vibration suppressing unit for suppressing the vibration of the mask. The vibration suppressing unit comprises a plurality of damping wires having ends fixed on opposing sides of the frame and stretched over the mask in a lengthwise direction, and a plurality of protrusions extending from the damping wires and spaced apart from each other a predetermined distance. The protrusions make contact with or are welded to slit formation elements of the mask, or are partly inserted into the slits and contact lateral sides of the neighboring slit formation elements to suppress vibration of the slit formation elements.

6 Claims, 3 Drawing Sheets

20a

20

20a
20d
20b
20d 20e
20f
20c
22
20d
22

10a 1
18a
12a 14a
16a
18a
16a

APERTURE GRILL FOR A COLOR CATHODE RAY TUBE

CROSS REFERENCE TO RELATED APPLICATION

This application is based on application No. 97-42960 filed in Korean Industrial Property Office on Aug. 29, 1997, which is incorporated to by reference.

BACKGROUND OF THE INVENTION (a) Field of the Invention

The present invention relates to an aperture grill for a color cathode ray tube (CRT) having a color selection function and, more particularly, to an aperture grill for a CRT which effectively suppresses vibration, and thereby facilitates the landing of electron beams on the phosphor screen to obtain high-definition color pictures.

(b) Description of the Related Art

Generally, color CRTs are designed to reproduce the original picture image on a glass screen by receiving the picture image signals from from an external source and exciting phosphors coated on the screen with electron beams emitted from the electron gun in accordance with the signals.

In order to obtain high-definition color pictures, the electron beams should land correctly on the phosphor screen. In this regard, a color selecting shadow mask is placed directly behind the screen to ensure that each beam hits the correct phosphor. As the electron beams pass through apertures perforated on the shadow mask, the generation of spurious colors due to the excitation of the wrong phosphors can be minimized.

In recent times, a shadow mask called an aperture grill has been mainly employed to realize a high-definition color CRT. In contrast to the common shadow mask, the aperture grill has a horizontally taut mask with a plurality of slits arranged thereon. The taut mask is tightly secured to a rigid frame.

FIG. 3 is a perspective view schematically showing a conventional aperture grill. As shown in FIG. 3, the aperture grill 1 includes a mask 12*a* having a plurality of slits 10*a*, a frame 14*a* for accommodating the mask 12*a*, and a springs 16*a* for mounting the frame 14*a* on the inside of a panel of the color CRT.

The mask 12*a* is taut in at least one direction and tightly secured to the frame 14*a*. The frame 14*a* has a rigid structure sufficient for bearing the tensional strength of the mask 12*a*.

Meanwhile, the common shadow mask is easily thermally expanded when electron beams impinge thereon. This phenomenon is usually called a doming defect of the shadow mask. But, in the aforementioned aperture grill 1, the doming defect can be minimized because the mask 12*a* is taut and tightly secured to the frame 14*a*.

Nevertheless, in order to obtain the high-definition color pictures, a critical problem should be resolved in the aperture grill 1. The problem is that: the aperture grill 1 severely vibrates during operation of the color CRT because the slit formation elements are thin metal strings susceptible to vibration even by resonant waves from the speaker mounted within the color television.

Therefore, a plurality of damping wires 18*a* are conventionally provided on the mask 12*a* in the lengthwise direction to suppress or damp the vibration of the slit formation elements. However, this approach does not effectively overcome this drawback.

SUMMARY OF THE INVENTION

Accordingly, an embodiment of the present invention is directed to an aperture grill for a Color CRT which substantially obviates one or more of the problems due to the limitations and disadvantages of the related art.

An object of an embodiment the present invention is to provide an aperture grill for a color CRT which effectively suppresses vibration of slit formation elements, thereby preventing the electron beams from landing on the wrong phosphors.

Additional features and advantages of the invention will be set forth in the description which follows, and in part will be apparent from the description, Or may be learned by practice of the invention. The objects and other advantages of the invention will be realized and attained by the structure particularly pointed out in the written description and claims hereof as well as the appended drawings.

To accomplish these and other advantages, the aperture grill for the color CRT includes a mask having a plurality of slits, a frame for securing the mask in a taut state, and a vibration suppressing unit for suppressing the vibration of the mask.

Preferrably, the vibration suppressing unit includes a plurality of damping wires each having ends fixed on opposing sides of the frame while being stretched over the mask in a lengthwise direction, and a plurality of protrusions extending from the damping wires and spaced apart from each other a predetermined distance. The protrusions make contact with or are welded to the slit formation elements of the mask, or are partly inserted into the slit portion and contact the lateral sides of the neighboring slit formation elements to suppress the vibration thereof.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate a particular embodiment of the invention and, together with the description, serve to explain the principles of the invention. In the drawings.

Figures 1A, 1B, 1C:
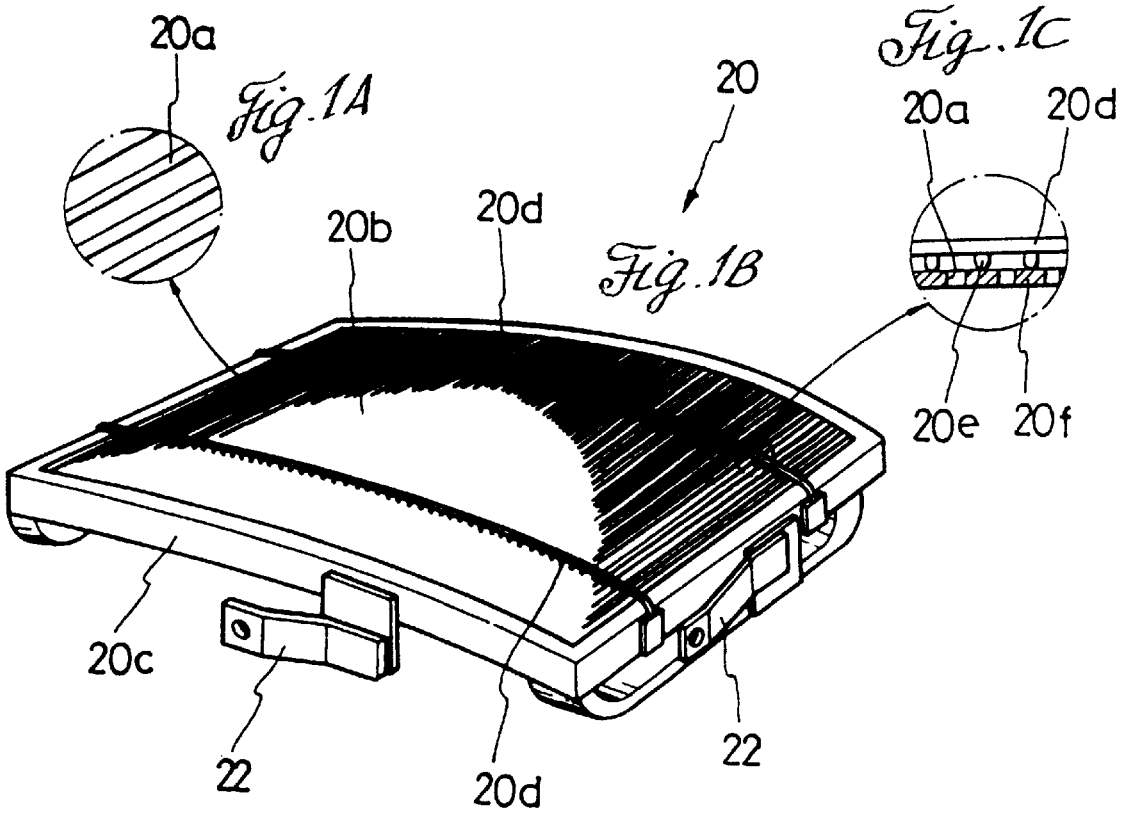
FIG. 1 (including FIGS. 1A, 1B and 1C) is a perspective view showing an aperture grill for a color CRT according to a first preferred embodiment of the present invention.

In the following detailed description, only the preferred embodiment of the invention has been shown and described, simply by way of illustration of the best mode contemplated by the inventor(s) of carrying out the invention. As will be realized, the invention is capable of modification in various other respects, all without departing from the invention. Accordingly, the drawing and description are to be regarded as illustrative in nature, and not as restrictive.

DETAILED DESCRIPTION OF THE INVENTION

Reference will now be made in detail to the preferred embodiments of the present invention, examples of which are illustrated in the accompanying drawings.

As shown in FIG. 1, the aperture grill 20 includes a mask 20*b* having a plurality of vertical slits 20*a* spaced apart from each other, and a frame 20*c* for securing the mask 20*b* in a taut state. The mask 20*b* is [tensed] taut in at least one direction, and the frame 20*c* has a rigid structure sufficient. for bearing the tensional strength of the mask 20*b*.

A plurality of springs 22 are provided on the sides of the frame 20*c* to mount the aperture grill 20 on the inside of a panel (not shown).

A vibration suppressing unit is arranged on the upper portion of the mask 20*b* to suppress vibration of slit formation elements 20*f*. The vibration suppressing unit includes damping wires 20*d* fixed on opposing sides of the frame 20*c* while being stretched over the mask 20*b*. Any number of dampening wires can be used, and, in this embodiment, two damping wires 20*d* are shown.

The vibration suppressing unit further includes a plurality of protrusions 20*e* protruding from each of the damping wires 20*d* and spaced apart from each other. The protrusions 20*e* face the upper side of the mask 20*b* and make contact with or are welded to the slit formation elements 20*f* of the mask 20*b*. Each damping wires is preferably formed with the same number of protrusions as the slit formation elements 20*f* to make a one-to-one corresponding link between them, or alternatively, formed with a number of protrusions constantly proportional to the number of the slit formation elements 20*f*. The protrusions are preferably formed with metals, crystalline glasses or ceramics which approximate the thermal expansion coefficient of the damping wires 20*d*. Therefore, even if the aforementioned aperture grill 20 is affected by the resonant waves from the speaker, its vibration can be minimized because the protrusions 20*e* of the damping wires 20*d* pressurize the slit formation elements of the mask 20*b* with a suitable force to suppress the vibration thereof. Consequently, in the color CRT employing such an aperture grill, the electron beams can be correctly directed to the desired phosphors without any disturbance, thereby realizing high-definition color pictures on the screen.

Figure 2:
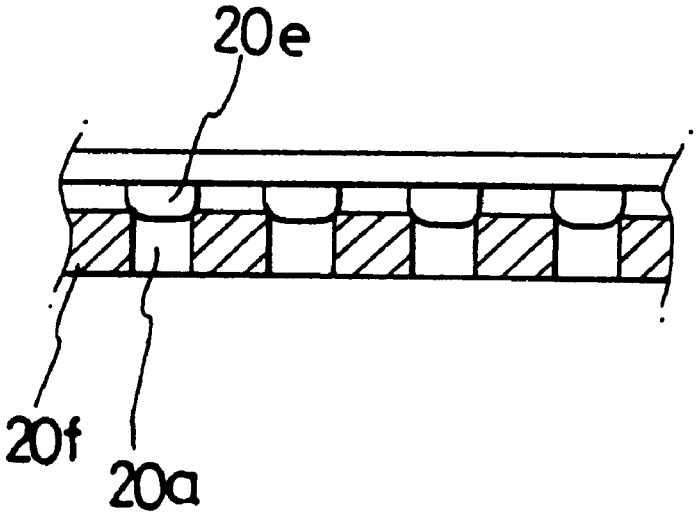
FIG. 2 is a fragmentary sectional view showing protrusions partly inserted into slits of a mask according to a second preferred embodiment of the present invention.
Figures 3A, 3B:
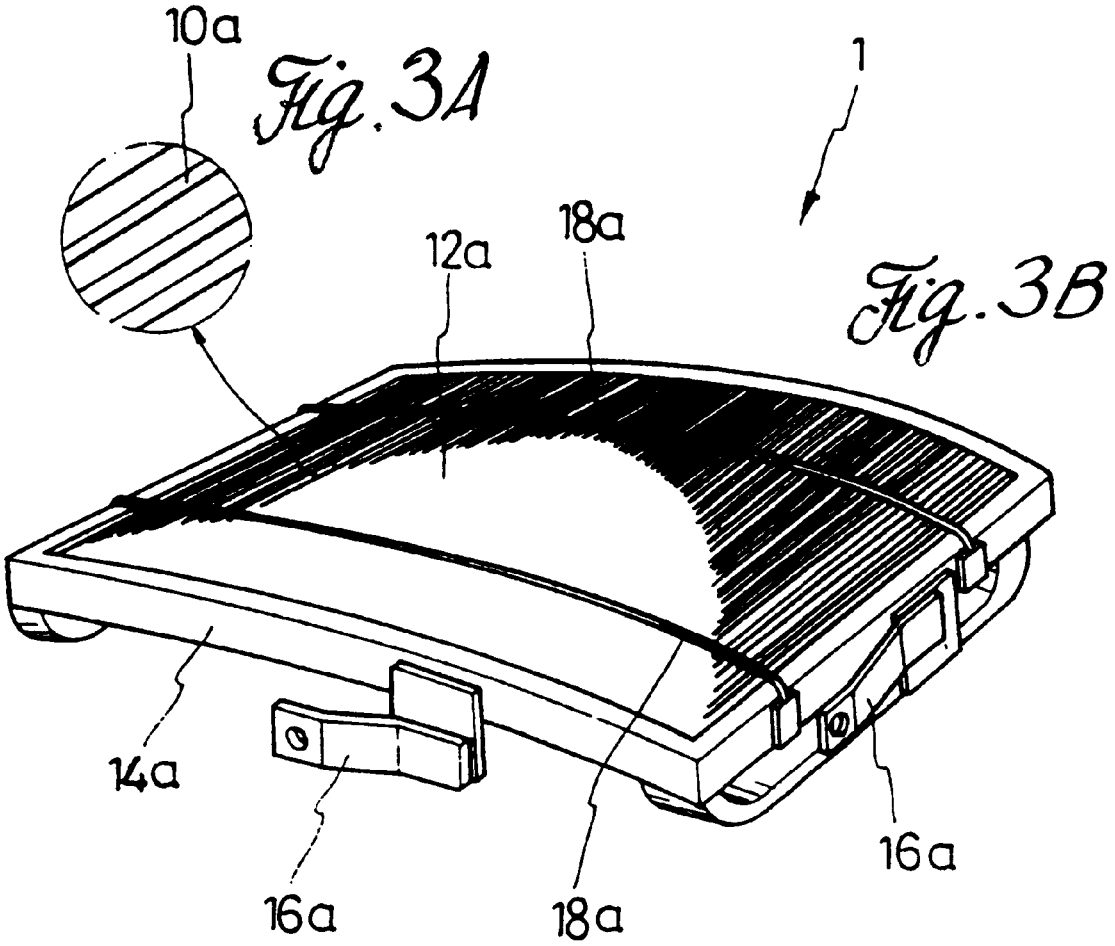
FIG. 3 (including FIGS. 3A and 3B) is a perspective view showing an aperture grill for a color CRT according to the prior art.

A second preferred embodiment of the present invention will now be described with reference to FIG. 2, wherein like numbers designate elements that are identical to those described in the first preferred embodiment.

In the second preferred embodiment, the protrusions 20*e* of the damping wires 20*d* are partly inserted into the slits 20*a* and contact the lateral sides of the neighboring slit formation elements 20*f*, thereby suppressing vibration of the slit formation elements 20*f*.

As described above, in an embodiment of the inventive aperture grill, vibration of the slit formation elements can be effectively reduced, thereby realizing high-definition color pictures on the screen.

It will be apparent to those skilled in the art that various modifications and variations can be made in the aperture grill for the color CRT of the present invention without departing from the spirit or scope of the invention. Thus, it is intended that the present invention cover modifications and variations of this invention provided they come within the scope of the appended claims and their equivalents.

What is claimed is:

1. An aperture grill for a color cathode ray tube, comprising:

a mask having a plurality of slits;

a frame for securing the mask in a taut state; and a vibration suppressing unit for suppressing vibration of the mask, said vibration suppressing unit comprising a plurality of damping wires stretched over the mask in a lengthwise direction, each of the damping wires having ends fixed on opposing sides of the frame, and a plurality of protrusions extending from the damping wires and spaced apart from each other a predetermined distance, the protrusions making contact with or being welded to slit formation elements of the mask, or being partly inserted into the slits and contacting lateral sides of neighboring slit formation elements to thereby suppress the vibration thereof.

2. The aperture grill of claim 1 wherein the number of the protrusions equal the number of the slit formation elements.

3. The aperture grill of claim 1 wherein the number of the protrusions are constantly proportional to the number of the slit formation elements.

4. The aperture grill of claim 1 wherein the protrusions are formed with a thermal expansion coefficient approximately equal to a thermal expansion coefficient of the damping wire.

5. An aperture grill for a color cathode ray tube, comprising:

a mask having a plurality of slit formation elements defining slits therebetween;

a frame for securing the mask in a taut state; and a plurality of damping wires transversing the slit formation elements, each of the damping wires having a plurality of protrusions each being in contact with one of the slit formation elements.

6. An aperture grill for a color cathode ray tube, comprising:

a mask having a plurality of slit formation elements defining slits therebetween;

a frame for securing the mask in a taut state; and a plurality of damping wire transversing the slit formation elements, each of the damping wires having a plurality of protrusions each being inserted into one of the slits and in contact with lateral sides of adjacent slit formation elements.

* * * * *